US006260372B1

(12) United States Patent
Burke

(10) Patent No.: US 6,260,372 B1
(45) Date of Patent: Jul. 17, 2001

(54) REFRIGERANT RECOVERY SYSTEM AND APPARATUS

(76) Inventor: Fredie Burke, 1820 S. Edgewood Dr., Alhambra, CA (US) 91803

( * ) Notice: Subject to any disclaimer, the term of this patent is extended or adjusted under 35 U.S.C. 154(b) by 0 days.

(21) Appl. No.: 09/495,679

(22) Filed: Feb. 1, 2000

(51) Int. Cl.[7] ..... F25B 45/00
(52) U.S. Cl. ..... 62/292; 62/475; 62/474
(58) Field of Search ..... 62/475, 474, 292

(56) References Cited

U.S. PATENT DOCUMENTS

| | | | | |
|---|---|---|---|---|
| 5,138,847 | * | 8/1992 | Rollins | 62/292 |
| 5,230,224 | * | 7/1993 | Ricketts et al. | 62/292 |
| 5,231,843 | * | 8/1993 | Keltner | 62/77 |
| 5,247,812 | * | 9/1993 | Keltner | 62/475 |
| 5,390,503 | * | 2/1995 | Cheng | 62/125 |
| 5,533,358 | * | 7/1996 | Crandall et al. | 62/292 |
| 5,685,161 | * | 11/1997 | Peckjian et al. | 62/149 |
| 5,761,924 | * | 7/1998 | Peckjian | 62/292 |

* cited by examiner

*Primary Examiner*—William Doerrler
*Assistant Examiner*—Mark Shulman
(74) *Attorney, Agent, or Firm*—George A. Maxwell

(57) ABSTRACT

A refrigerant recovery system and apparatus to connect with a refrigeration machine to selectively receive liquid and vapor refrigerant therefrom and to clean, purify and dry that refrigerant for present reuse; said apparatus includes a recovery line with an inlet connected with a related refrigeration machine, a particulate matter filter and de-acidifier devise with an inlet connected with an outlet end of the recovery line, a liquid-vapor refrigerant flow control devise operating to selectively conduct and cause liquid refrigerant flowing through it and expand to a gaseous state and to selectively and freely conduct and cause vaporous refrigerant to flow through it, said refrigerant flow control devise has an inlet connected with an outlet of the filter and de-acidifier devise and an outlet connected with an inlet of a refrigerant conducting vapor line, an oil separator devise with a refrigerant inlet connected with an outlet end of the vapor line, a refrigerant dryer devise with an inlet connected with an outlet of the oil separator devise and an outlet connected with an inlet of a refrigerant recovery pump, and a refrigerant supply tank connected with an outlet of the pump.

13 Claims, 4 Drawing Sheets

M
U-1
U-2
16
17
18
14
15
11
19
10
12
H
T
21
20
P 19
22
23
24
25
25'
26
27
28
29
31
32
33
33'
34
34'
37
100
101
102
103
104
I/V
S
F/D
A
B
F-1
F-2
I
P
PV
T
O

REFRIGERANT RECOVERY SYSTEM AND APPARATUS

BACKGROUND OF THE INVENTION

This invention has to do with the art of refrigerant charged refrigeration; refrigerated air conditioning equipment and is particularly concerned with a novel, light weight, portable refrigerant recovery system and apparatus.

It has become common practice to install or otherwise equip industrial, commercial and dwelling buildings with air-conditioning machines that serve to chill or lower the temperature of air within the buildings and to maintain it at desired comfort levels.

The overwhelming majority of air-conditioning machines are charged with refrigerants, such as FREON, include refrigerant evaporator coils about which air is to be chilled is circulated by means of blowers or fans. The machines further include electric motor-driven compressor pumps that receive and compress gaseous refrigerant existing the evaporator coils; condenser coils receiving the compressed refrigerants from the pumps and which serve to cool and condense the refrigerants into a liquid state. The liquid refrigerants flowing from the condenser coils are conducted into holding tanks or equivalents thereof. The cooled pressurized liquid refrigerants in the holding tanks are conducted through flow-metering expansion valves or equivalent means and vents into the inlet ends of the expansion coils where it expands and absorbs heat from the coils, chilling the coils. The chilled coils absorb heat from the air flowing across their exteriors.

In addition to the above machines of the character referred to above include various censors, monitoring and control means that work to make the machines perform their intended functions in prescribed ways.

The great majority of the classes of machines described above include; pump and condenser coil units that are suitably mounted at the exteriors of their related buildings and expansion coil units that are suitably mounted within their related buildings. In other instances the condensing and expansion coil units are suitably incased and mounted within window openings or the like in their related buildings.

Machines of the nature and character set forth above require periodic or seasonal maintenance servicing and often require that parts thereof be repaired and/or replaced. When being serviced and/or repaired it is not infrequent that the charge of refrigerant in the machines be removed and that the machines be recharged with new or fresh refrigerant when put back into service.

It has been determined that refrigerants such as FREON produced by Dupont, if let to escape freely into the atmosphere, work adverse affects on the atmosphere. Accordingly, strictly enforced laws require that those servicing and working on air-conditioning machines and, the alike prevent the escape of refrigerant into the atmosphere. To this end when it is necessary that the refrigerant be removed from a machine, a drain line is connected to the machine where gaseous refrigerant occurs. The drain line extends to a motor driven gas compressing "recovery pump". The recovery pump receives the gaseous refrigerant, compresses it and delivers it through an elongate cooling line in which it condenses and flows into a refrigerant recovery tank. It is to be noted that the pumps for refrigeration machines and recovery pumps are, most often, piston pumps with popet or reed valves that are made to receive and compress gaseous refrigerants. If liquid refrigerants are let to enter the intakes of those pumps, the pumps hydraulically "lock-up" and cease to function. When such pumps are caused to lock-up, it is not infrequent that they are irreparably damaged. Accordingly, when recovery pumps are used to remove refrigerants from refrigeration machines it is necessary to connect those pumps to portions of the machines where only gaseous refrigerants can be recovered. Accordingly, during the removal of refrigerants from refrigeration machines in accordance with old practices, the liquid refrigerants in the machines must be let to "boil off" to a gaseous state and rise in the machines before it can withdraw from them by the recovery pumps. Boiling off of liquid refrigerants as noted above is a slow and time-consuming process. Further, during the process of letting liquid refrigerant boil off in refrigeration machines the gaseous refrigerants separate from all of the solids and less volatile materials carried thereby and those materials are let to settle and collect in the machines. Accordingly, substantial amounts of undesirable and/or harmful impurities are left in the machines and immediately contaminate new or fresh refrigerants that are introduced into the machines.

It is believed apparent that if the refrigerants in the lower portions of refrigeration machines is extracted there from in a liquid state the solids and other impurities suspended therein and/or carried thereby are extracted or the refrigerants and negligible amounts of impurities are let to remain in the machines to contaminate fresh refrigerants introduced into them.

The refrigerant recovery tanks that are commonly employed when draining refrigeration machines are those common refrigerant supply tanks provided by the manufacturers and distributors of refrigerants. It is common practice for the service and repairmen to return the tanks filled with waste or dirty refrigerants to their refrigerant suppliers for disposal and/or handling. Since the refrigerants are expensive commodities, most suppliers and distributors of refrigerants give the service and repairmen credit for the refrigerants returned to them. That credit is usually applied to the servicemen's next purchases of refrigerants.

Waste refrigerants collected by suppliers and the like are commonly processed to original or new state and put back into circulation in the industry.

It is to be noted that the compressor pumps in the refrigeration machines are lubricated with oils that absorb and carry water and that become laded with acids when put to their intended use. The acids adversely work upon the parts of the machines and upon the refrigerants. As a result of the foregoing, refrigerants in machines become diluted and laded with acid and waste materials.

In an effort to slow the generation of acids and their harmful effects, most refrigeration machines are equipped with small, cartridge-like water and oil absorbing and/or separating devices containing acid neutralizing on base materials. Those devices are short lived and must be frequently replaced. Unfortunately, in the majority of instances the owners of such machines fail to have their machines serviced in a timely manner and do not call for service until they experience or note that their machines (often due to acid-related damage) are no longer functioning as they should function.

It has long been recognized by those in the art that a great deal of the time and costs that are expended in servicing refrigeration machines would be saved if there was a small, compact, and portable means that could be taken to a job site and that would work to remove or drain refrigerant from a machine in a short and reasonable period of time and that would work to clean the refrigerant of solids, acids, water and oil for safe and effective reintroduction of the refrigerant into the machine being serviced.

It is my understanding that unsuccessful efforts to provide means of the character referred to above have been made by others. Those efforts have resulted in systems and apparatus that are too large, too heavy, too complicated and/or too costly to gain acceptance in the art.

OBJECTS AND FEATURES OF THE INVENTION

It is an object of this invention to provide a small, compact and light weight refrigerant recovery system and apparatus that the average air conditioning service man can easily and conveniently carry to the sights of air conditioning and other refrigeration machines to be serviced and that works to rapidly, effectively, and efficiently recover refrigerants from the machines and condition them for reintroduction into those machines or put them to other use.

It is an object and a feature of this invention to provide a system and apparatus of the general character referred to above that first works to withdraw or extract liquid refrigerant from a related refrigeration machine; that next works to induce rapid expansion of the refrigerant to a gaseous state; that next works to extract gaseous refrigerant from the machine; that next works to compress the gaseous refrigerant; and that finally works to deliver the compressed refrigerant into a recovery tank in which it condenses into a liquid state.

It is yet another object and a feature of the invention to provide an apparatus of the general character referred to above that includes a deacidifier and particulate material filtering device with inlet and outlet fittings, coupling means connecting the refrigeration machines with the inlet fitting, a gas-liquid refrigerant flow control device with an inlet end connected with the outlet fitting and an outlet end connected with an inlet of an oil separator device, a filter dryer device with an inlet connected with an outlet of the oil separator device and an outlet connected with the inlet of a recovery pump; and, a refrigerant receiving tank connected with an outlet of the pump.

Finally, it is a feature of the invention to provide an apparatus of the character referred to above that includes electric powered heater means at the oil separator device that works to maintain the temperature within the separator below the dew point of oil and above the dew point of the refrigerant.

The foregoing and other objects and features of the invention will be apparent and fully understood from the following detailed description of preferred forms and embodiments of the invention, throughout which description reference is made to the accompanying drawings.

DETAILED DESCRIPTION OF THE INVENTION

Figure 1:
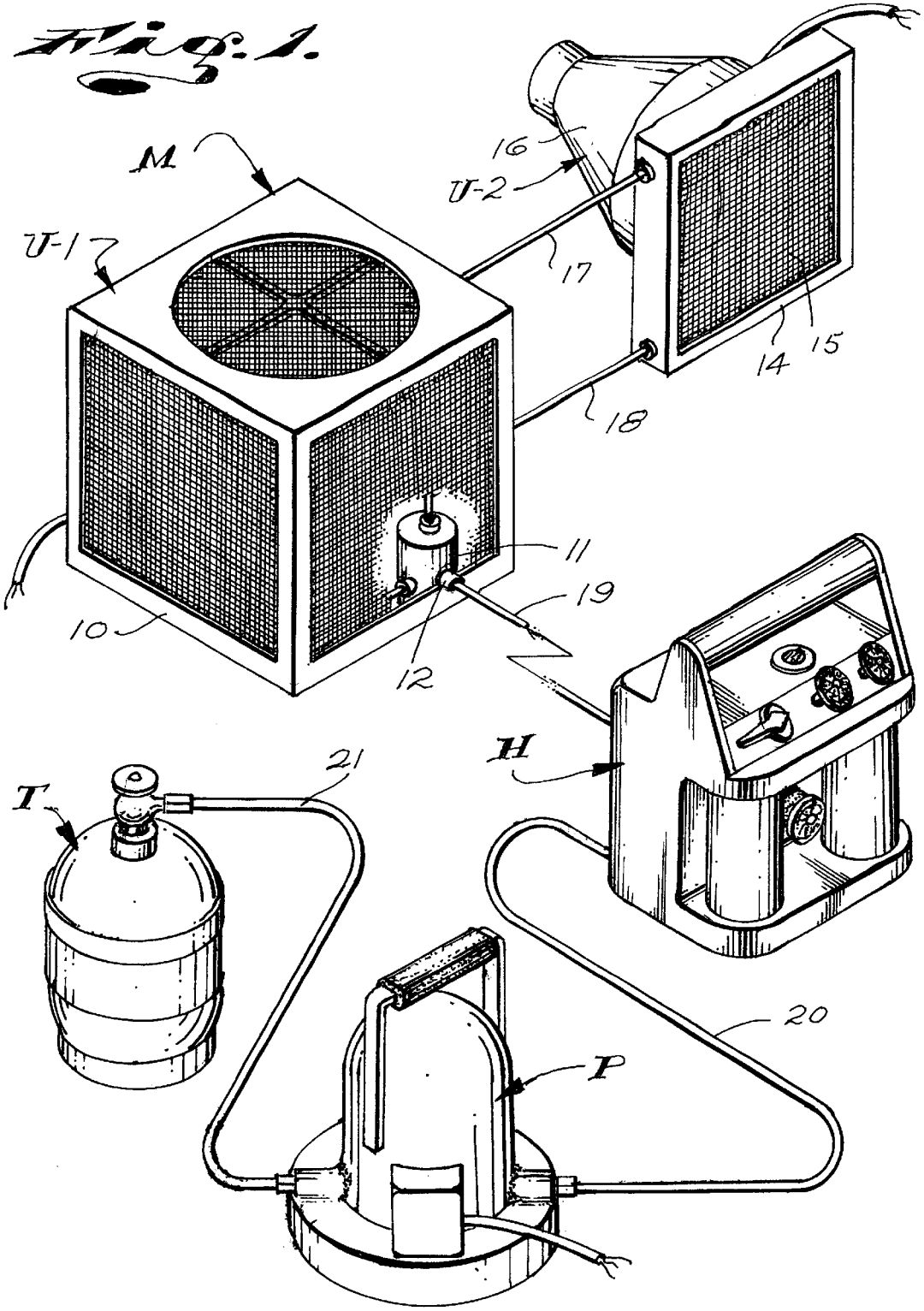
FIG. 1 is an isometric view of one preferred embodiment of the invention showing it related to an air conditioning machine.

Referring to FIG. 1 of the drawings I have illustrated one typical or basic form of air conditioning machine M. The machine M includes a pump-condenser unit U-1 and an evaporator unit U-2.

The unit U-1 is shown as including a box-like housing 10 in which an electric motor-driven pump (not shown), a condenser coil (not shown) and a fan (not shown) are positioned in accordance with old and common practices.

In addition to the above, for the purpose of this disclosure, the unit U-1 is shown as including a liquid refrigerant accumulator tank 11 with a suitable drain fitting 12. In practice, the fitting 12 can be at any part of the unit U-1 from which liquid refrigerant can be withdrawn.

The unit U-2 is shown as including a box-like housing 14 in which an evaporator coil 15 is arranged and with which a fan or blower device 16 is related in accordance with old and common practices.

The units U-1 and U-2 are connected with each other by elongate refrigerant conducting lines 17 and 18.

The machine M illustrated and briefly described above is typical of but one form of machine with which my new refrigerant recovery system and apparatus can be advantageously related. Such machines are so well known to all of those who are skilled in the art that further detailed illustration and description of the machine M need not and therefore will not be provided.

Related to the machine M is a manually portable housing unit H in which parts of my new apparatus are housed; and electric motor-driven manually portable refrigerant recover pump P; and, a refrigerant recovery tank T.

The apparatus within the housing H is connected with the fitting 12 of the machine M by an elongate, flexible, high-pressure hose or line 19; the jump P is connected with the apparatus within the housing by an elongate, flexible, high-pressure conducting hose or line 20; and, the pump P is connected with the tank T by an elongate flexible high-pressure hose or line 21.

Figure 2:
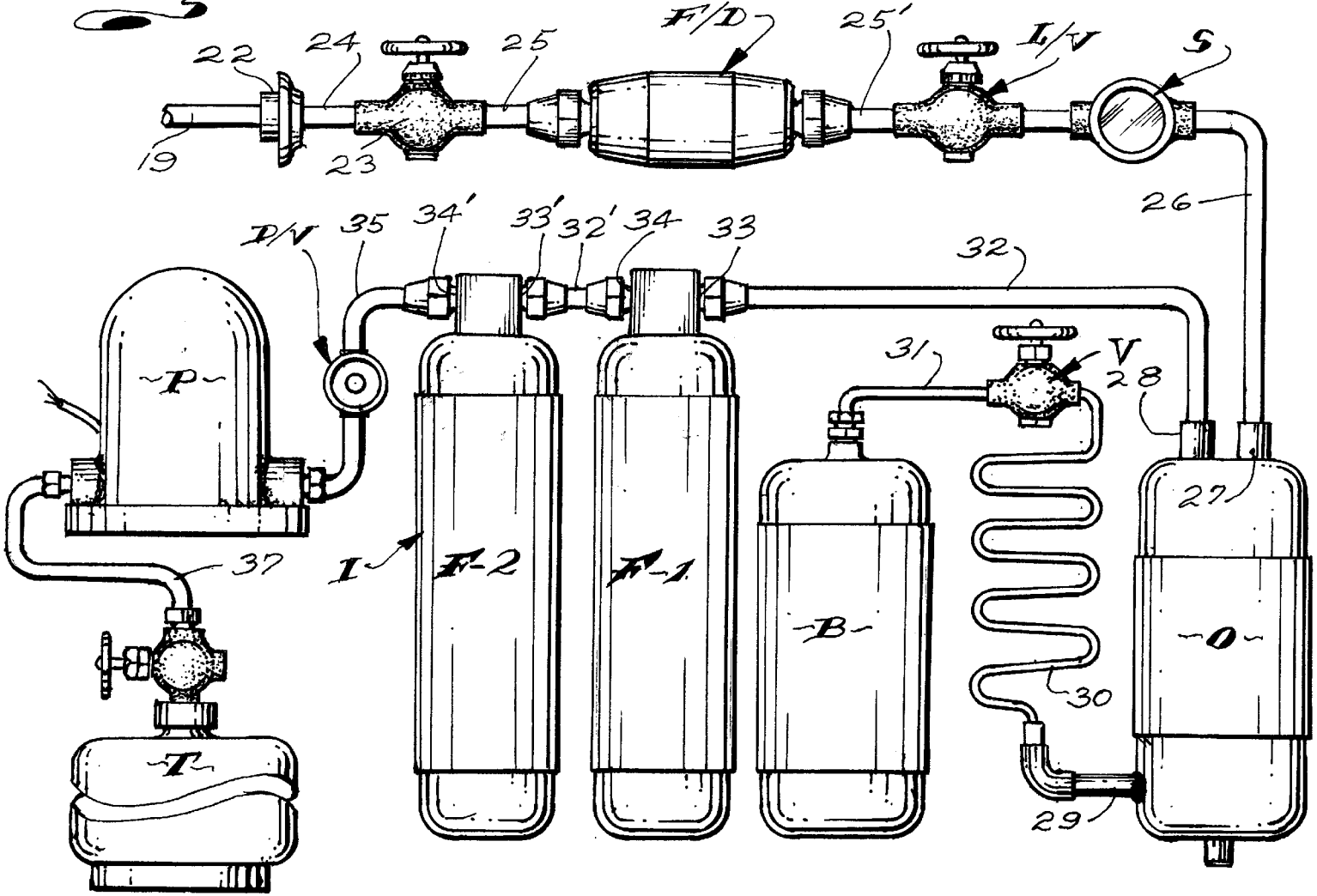
FIG. 2 is a diagramatic view of one embodiment of the invention.

FIG. 2 of the drawings is a diagrammatic view showing the elements or parts of a basic or simple embodiment of my invention. The parts are arranged to most clearly show and teach the functional aspects of the invention. It is to be noted and it will be apparent that in practice the parts of the apparatus illustrated can be moved and rearranged as desired or as circumstances require without departing from the broader aspects and spirit of my invention.

Starting at the upper-left hand comer portion of FIG. 2 of the drawings, the, apparatus includes a suitable refrigerant inlet fitting 22 that is carried by and is readily accessible at the exterior of the housing H. The fitting 22 is suitably connected with the downstream end of the hose 19 that extends to and is connected with the fitting 12 of the machine M.

The fitting 22 is connected with the upstream end of a manually operable on and off valve 23 by a flow line 24.

The downstream end of the valve 23 is suitably connected with a part of a quick releasable inlet coupling an inlet of a particulate filtering and deacidifier device F/D by a flow line 25. The device F/D is a cartridge like device containing a bed or pack of selected particulate base materials such as activated allumina that serves to separate or collect particulate material from liquid or gaseous refrigerants conducted through it and that collects or reacts with and neutralizes acid compounds carried by the refrigerants.

In my reductions to practice of the invention the device F/D is that cartridge filter product produced by Sporlan Corp. and sold under that company's registered trademark CATCH-ALL. The cartridge is approximately 4½ inches long and 1¼ inches in diameter. It is positioned for easy access and removal from its related parts. It is suitable for approximately 24 hours of operation and use of my new apparatus before its effectiveness to remove solids and/or to neutralize acids has been spent. It is therefore intended that the device F/D of my apparatus be removed and replaced with a new or fresh device when it has been used for about 24 hours.

Downstream from the device F/D is a liquid vapor control device L/V with upstream and downstream ends and that functions to selectively conduct liquid or vapor freon. The details of the device L/V will be described in the following. The device L/V is connected with an outlet or downstream end of the device L/D by means of a quick disconnect fitting or coupling and a refrigerant conducting line 25'.

The downstream end of the device L/V is connected with a refrigerant conducting line 26 in which a liquid/vapor sensing or flow indicating device S is engaged. The device S is shown as a simple sight glass.

Downstream from the line 26 is a common, commercially available, elongate vertically extending tank-type oil separator device O with refrigerant inlet and outlet fittings 27 and 28 at its upper end and an oil outlet fitting 29 at its lower end. The separator device O is about 15 inches in the vertical extent and 5 inches in diameter.

The refrigerant inlet fitting of the device O is connected with the downstream end of the line 26.

The oil outlet fitting 29 of the device O is connected with the inlet of a flow-metering device 30. The device 30 is shown as a small diameter, capillary tube like line. The line 30 extends to and is connected with the inlet side of a normally closed manually operable oil drain valve V. The outlet side of the valve V is connected with a line 31 that leads into or is otherwise suitably connected with a waste oil receiving tank or bottle B. The flow control device 30 is provided so that upon opening of the valve V the rate at which oil collected in the device O is drained therefrom is slowed to a rate that enables the operator of the device to easily and conveniently affect transfer of oil from the device O to the tank or bottle B without the spillage or loss of more than a trace of refrigerant.

The valve V and bottle or tank B are positioned so that both are easily and conveniently accessible.

When the bottle is suitably filled with oil it can be easily removed from the housing H and its contents suitably disposed of.

The refrigerant outlet fitting 28 of the device O is connected with the inlet of a filter/dryer device I by a line 32. In the form of the invention illustrated the filter dryer device includes a first filter/dryer unit F-1 with an inlet fitting 33 with which the line 32 is connected. The unit F-1 has an outlet fitting 34 that is connected with an inlet fitting 33' of a second filter dryer unit F-2 by a line 32'. The unit F-2 has an outlet fitting 34' that is connected with the inlet side of a manually operable normally open discharge valve D/V by a line 35. The valve is carried by and positioned in housing for easy and convenient access.

The two series connected units F-1 and F-2 are common commercially available cartridge type filter-dryers. The provisions and use of two such dryers have been adopted to obtain sufficient volume and capacity to affect drying of the gaseous refrigerant without excessive chilling and freezing water therein.

The outlet side of the valve D/V is suitably connected with the inlet of an electric powered motor driven portable refrigerant recovery pump P by a hose or line 36.

The outlet of the pump P is connected with a common or standard refrigerant supply tank or recovery tank T by a hose or line 37.

It is to be noted that the apparatus of my invention thus far described, from the inlet fitting 22 to the valve D/V is within the housing H. In practice the housing H in which the above noted portion of the apparatus is positioned is about 12 inches wide, 10 inches high and 7 inches deep. The housing H, with its parts therein, weighs approximately 15 pounds.

Figure 4:
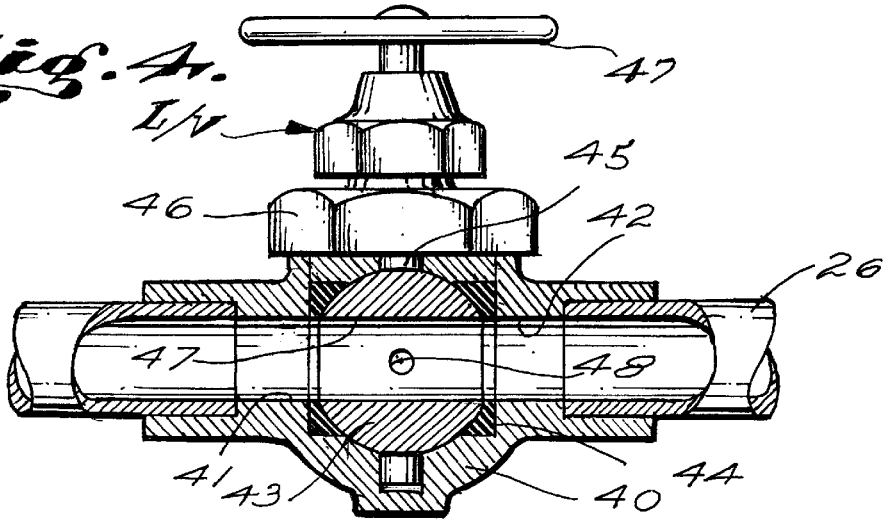
FIG. 4 is a sectional view of a liquid-vapor refrigerant flow control device.
Figure 5:
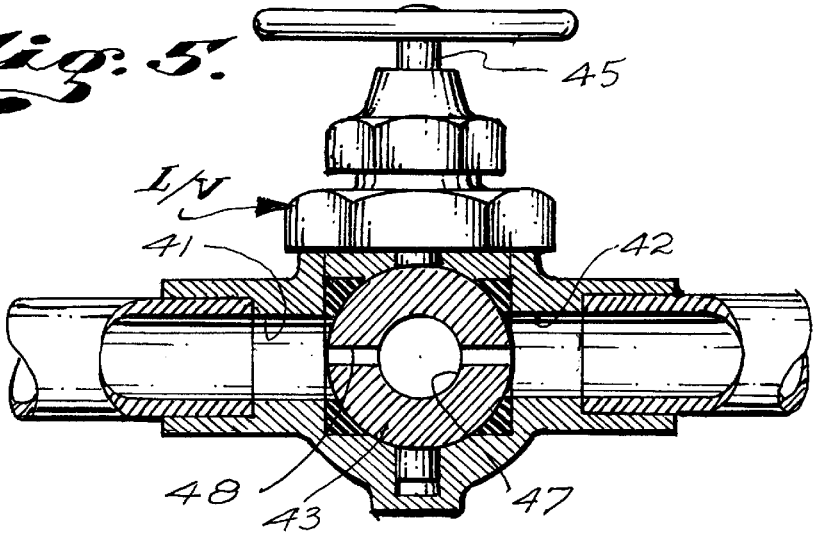
FIG. 5 is a view similar to FIG. 3 showing parts in another position; and, FIG. 6 is a view showing another form of liquid-vapor refrigerant flow control device.

Referring to FIG. 4 and FIG. 5 of the drawings, the liquid/vapor control device L/V is shown as a modified standard, manually operable, high pressure-low temperature ball valve. The valve includes a body 40 of suitable design and construction with, for example, one-quarter inch upstream or inlet and downstream or outlet openings 41 and 42. A spherical ball 43 is supported in the body by teflon seats 44. The ball has a radially outwardly projecting stem 45 that extends through a suitable sealing gland device 46 and on which a manually accessible operating handle 47 is carried. The ball has a quarter inch through opening 47 on an axis normal to the axis of the stem.

In addition to the above the ball is formed with a refrigerant flow control opening 48 on the same radial plane and on an axis normal to the axis of the opening 47. The opening 48 is about 0.014 inches in diameter and is the equivalent of a refrigerant expansion valve or capillary tube.

In FIG. 4 of the drawings the opening 46 is shown aligned with the passages 41 and 42. When in this position the valve like device is suitable to conduct a vaporous refrigerant. In FIG. 4 of the drawings the ball has been turned 90 degrees and the refrigerant expansion opening 48 is aligned with the passages 41 and 42. When in this second position the opening 48 conducts liquid refrigerant downstream and discharges it into the larger diameter passage 42 and thence downstream into and through the line 26 where it continues to expand to a gaseous state.

Figure 3:
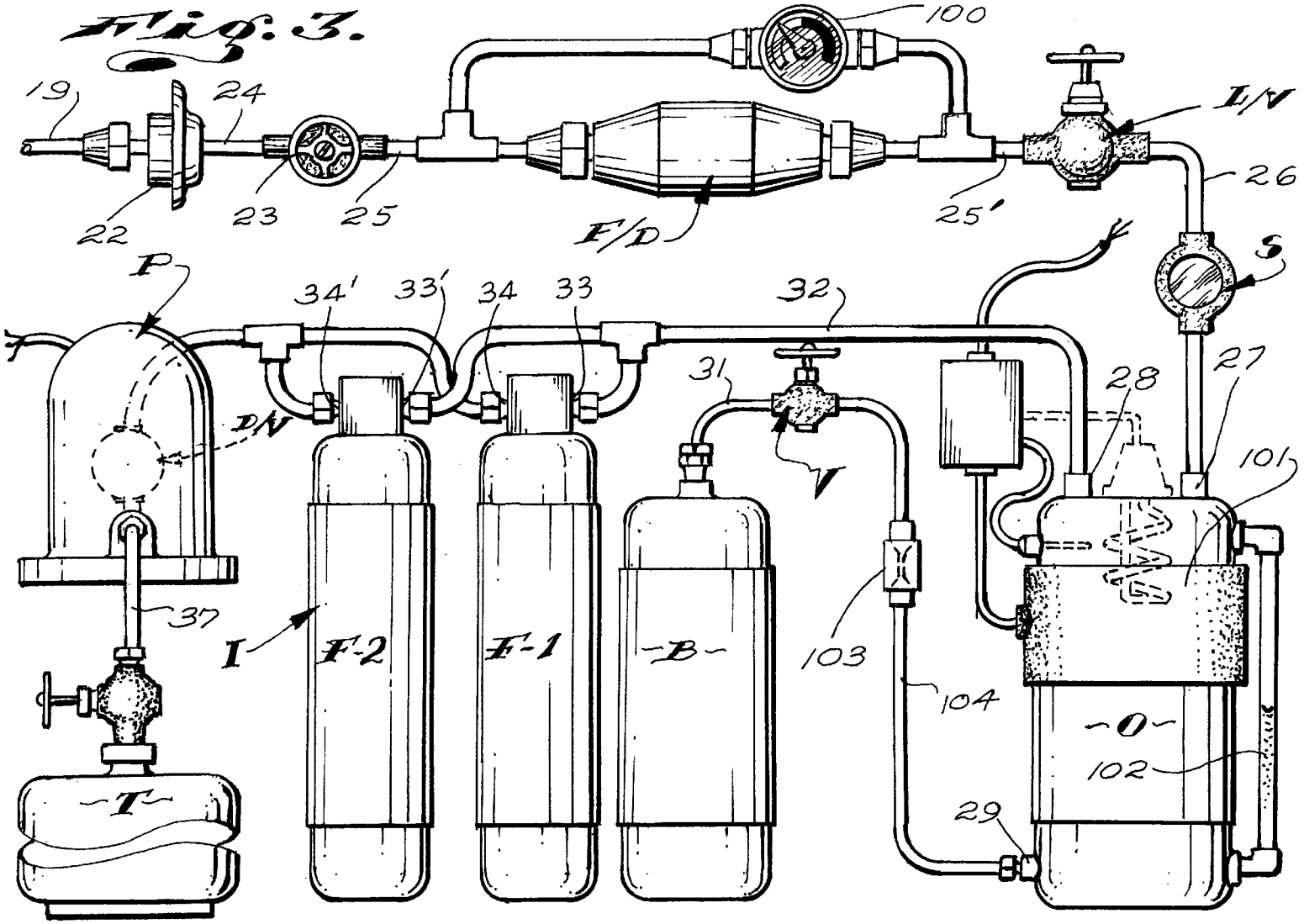
FIG. 3 is a diagramatic view of another embodiment of the invention.
Figure 6:
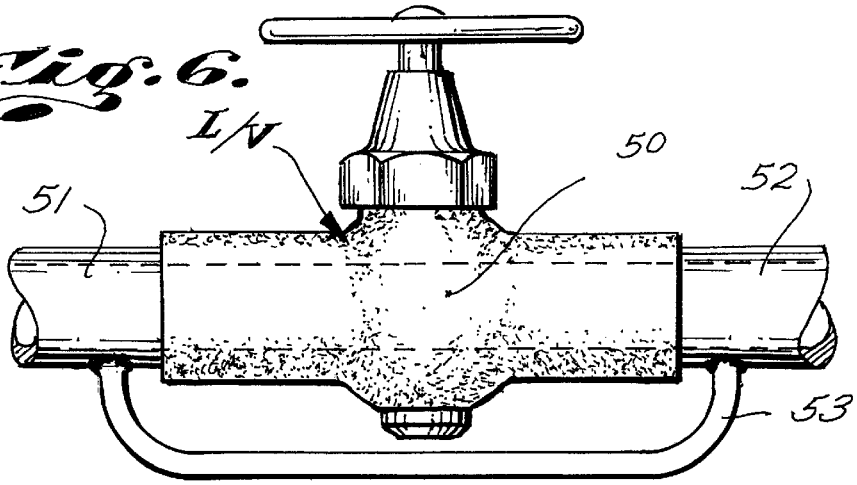

In FIG. 6 of the drawings I have shown another form of liquid-vapor control device that is the mechanical equivalent of the device shown in FIGS. 3 and 4 of the drawings. In this form of the invention the device includes a simple manually operable ¼ inch on and off valve 50 connected with and between related upstream and downstream refrigerant conducting lines 51 and 52 and a refrigerant conducting capillary tube 53 that is connected with and extends between the lines 51 and 52 or, if preferred between fittings at the upstream and downstream ends of the valve 50, to bridge the valve 50. When liquid refrigerant is flowing through the lines 51 and 52 the valve is closed. When gaseous refrigerant is flowing through the lines 51 and 52 the valve is open. When the valve is open, the fact that some of the gaseous refrigerant will flow through the tube 53 is inconsequential.

It is to be noted that when the apparatus is in use and operating to extract and recover liquid refrigerant from the machine M with which it is related, the refrigerant in my apparatus upstream of the device L/V is under positive pressure and the pump P draws a negative pressure at the downstream of that device. Accordingly, the liquid refrigerant is forcibly conducted through the device L/V. The foregoing induces the rapid extraction of liquid refrigerant from the machine and rapid expansion of the liquid refrigerant to a gaseous state. Accordingly, the time required to extract liquid refrigerant from the machine M is a small fraction of that time that would be required if the refrigerant in the machine were let to boil off within the machine before extracting it therefrom.

It is important to note that when the apparatus is in use and operating to receive liquid refrigerant from the machine M and delivers vaporous refrigerant to the pump P is not subjected to unnecessary loading. A load differential on the load on the pump results when liquid refrigerant ceases to enter the apparatus. That differential of load is sufficiently audible so that the operator of the apparatus is signaled that that the device L/V should be manually operated to that position where gaseous refrigerant is free to flow through it.

In accordance with the foregoing it will be apparent that when the above described apparatus of my invention is connected with and between a refrigeration machine and a refrigerant recovery pump, dirty or impure liquid refrigerant is first extracted from the machine. Thereafter gaseous, impure refrigerant is extracted from the machine. The extracted impure refrigerant is cleaned of particulate matter and is deacidified by the device L/V. The filter and deacidified liquid refrigerant is expanded to a gaseous state. Thereafter oil is removed from the gaseous refrigerant by the device O. The filtered, deacidified and oil free refrigerant is thereafter further filtered and dried by the device F. The pure and dry refrigerant is then drawn into the recovery pump and compressed. The compressed pure refrigerant is conducted into the refrigerant recovery tank T, ready to recharge the refrigeration machine or put to other desired use.

It is to be noted that the gaseous refrigerant delivered to the recovery pump is sufficiently cool and under sufficient pressure so that the pump is subjected to minimum loading and the refrigerant is compressed by the pump so that when it is conducted into the recovery tank it is conditioned to assume a liquid state.

It is also to be noted that the cost of servicing and maintaining the apparatus is a small fraction of the average cost of pure refrigerant exacted by the producers and suppliers of refrigerants.

It is to be further noted that the apparatus is added to and made a part of the old commonly used refrigerant recovery means or system (recovery pump, recovery tank and related lines) and is sufficiently small and lightweight so that it creates no objectionable inconveniences.

In FIG. 3 of the drawings I have diagrammatically illustrated another embodiment of my invention in which means to better monitor, control and enhance the operation of my invention are included. In FIG. 3 of the drawings the like and/or equivalent parts in the apparatus illustrated in FIG. 2 are identified by like reference numbers and characters.

Referring to FIG. 3 and commencing at the upstream portion thereof a pressure differential sensing and indicating device 100 is suitably connected with and between the lines 25 and 25' or the upstream and downstream ends of the device F/D. As the device F/D becomes loaded with filtrates and the like the device 100 indicates the pressure drop. When the indicated pressure drop reaches a predetermined amount it is time that the device F/D should be replaced with a new or fresh device. In the case illustrated the device 100 is a simple, standard differential pressure gauge.

Continuing downstream through the apparatus to the oil separator device O the device O is provided or equipped with a thermostatically controlled electric powered heater means or device 101 that works to maintain the temperature in the upper portion of the tank of the device O above the dew point of the refrigerant and below the dew point of the oil.

The provision of the heater device 101 is necessary in cold climes where the tank of the device O is chilled by the ambient atmosphere to a degree or extent that vaporous refrigerant therein condenses to a liquid state and drops in the tank to combine with the oil at the bottom thereof.

In warm climes where the ambient temperature maintains the tank of the device O at a suitable operating temperature the heater device 101 is inactive.

In addition to the above the tank of the device O is provided with a side glass 102 that can be monitored by the operator of the system and that advises the operator when it is appropriate to open the valve V and drain oil collected in the device O into the bottle B.

In practice, the heater device 101 can be a sleeve or band like resistance heater unit engaged about the exterior of the tank, at the upper portion thereof. The temperature sensing and control means provided therefore can be fixed to the exterior of the tank and made responsive to the temperature of the tank. Alternatively, the heater device can be in the form of a jacketed resistance heater coil positioned within the upper portion of the tank and the temperature responsive control means can include a probe entered into the tank.

In this second embodiment of my invention the flow metering or control device between the device O and the valve V is a simple flow control orifice plate device 103 engaged in a line 104 that extends between the device O and the valve V.

In the first illustrated and described embodiment of my invention the two cartridge type filter dryer units F-1 and F-2 of the filter dryer device J are series connected. In practice, there is a tendency for the first or upstream unit F-1 to cool to an extent that water carried by the refrigerant cools to an extent that it freezes and stops F up in that unit to stop the flow of gaseous refrigerant into and through the filter-dryer device. The foregoing is prevented by operation of the valve 23 and/or the valve D/V to slow the rate of flow of refrigerant into and through the apparatus and so that the volumatic flow of refrigerant into the unit F-1 is insufficient reduced to prevent freezing up of the filter-dryer device.

Another shortcoming in the series connected devices F-1 and F-2 resides in the fact that the first unit F-1 becomes spent long before the second unit F-2 becomes spent. This creates an inconvenient management problem.

In the second embodiment of the invention shown in FIG. 3 of the drawings the filter-dryer units F-1 and F-2 or the device F are connected in parallel thereby reducing the volume of flow of refrigerant into the unit F-1 by 50%. Further, the units F-1 and F-2 become spent at the same time.

It is to be noted and understood that the provision and use of the two filter-dryer devices F-1 and F-2 is, at this time, dictated by the fact that single filter-dryer units of suitable and effective size and capacity are not commercially available. In practice, if and when circumstances permit a single filter dryer unit of suitable size and/or capacity can be and will produced or purchased for use in my invention.

Having described typical preferred forms and embodiments of my invention I do not wish to be limited to the specific details herein set forth but wish to reserve to myself any modifications and/or variations that might appear to those skilled in the art and that fall within the scope of the following planes:

What is claimed is:

1. A refrigerant recovery system and apparatus to connect with a refrigeration machine to extract liquid and gaseous refrigerant therefrom and to clean, purify and dry the refrigerant for present reuse; said apparatus includes an elongate recovery line with an inlet end to connect with a liquid refrigerant conducting part of a related refrigeration machine and an outlet end connected with an inlet of a particulate matter filter and deacidifier device, a flow line with an inlet end connected with an outlet of the filter and deacidifier device, a liquid-vapor refrigerant flow control device to selectively receive and meter the flow of liquid refrigerant through it for expansion to a gaseous state and to receive and freely conduct gaseous refrigerant through it, said refrigerant control device has an inlet connected with an outlet of the flow line and an outlet connected with an inlet end of a conducting line, an oil separator device with a refrigerant inlet connected with an outlet end of the vapor conducting line, a first transfer line with an inlet end connected with an outlet of the separator device and an outlet connected with an inlet of a refrigerant filter-dryer device, an elongate conductor line with an inlet end connected with an outlet of the filter dryer device, a recovery pump with an inlet connected with an outlet end of the conductor line, a delivery line with an inlet end and connected with the pump and an outlet end connected with a refrigerant supply tank.

2. The apparatus set forth in claim 1 that further includes an on and off flow control valve between the recovery line and the filter and deacidifier device.

3. The apparatus set forth in claim 1 that further includes an on and off control valve in the delivery line and to the pump.

4. The apparatus set forth in claim 1 that further includes a first on and off control valve between the recovery line and the filter and deacidifier device and a second on and off control valve in the delivery line to the pump.

5. The apparatus set forth in claim 1 where in the liquid vapor control devise includes an on and off flow control means with a large diameter flow passage to conduct gaseous refrigerant and a small diameter flow passage to conduct liquid refrigerant.

6. The apparatus set forth in claim 5 that further includes an on and off flow control valve between the recovery line and the filter and deacidifier device.

7. The apparatus set forth in claim 5 that further includes an on and off flow control valve in the delivery line.

8. The apparatus set forth in claim 5 that further includes a first on and off flow control valve between the recovery line and the filter and deacidifier device and a second on and off flow control valve on the delivery line to the pump.

9. The apparatus set forth in claim 1 where in the liquid vapor control device includes a valve body with axially aligned and axially spaced inlet and outlet passages defining the inlet and outlet of that device, a valve part sealingly positioned in the body between the inlet and outlet passages and rotatable on an axis normal to the axis of said passages, and a large diameter gaseous refrigerant conducting through opening in the valve part on an axis normal to the axis of the valve part and intersecting the axes of the passages, a small diameter liquid refrigerant conducting opening in the valve part on an axis which is normal to the axis of the valve part and intersects the axis of the passages and is substantially normal to and intersects the axis of the large diameter opening, and an operating means to rotate the valve part to selectively align the large and small diameter openings with the passages.

10. The apparatus set forth in claim 9 that further includes an on and off flow control valve between the recovery line and the filter and deacidifier device.

11. The apparatus set forth in claim 9 that further includes a first on and off flow control valve between the recovery line the filter and deacidifier device and a second on and off flow control valve in the delivery line to the pump.

12. A system and apparatus set forth in claim 1 where in the oil separator device includes an elongate vertical tank with upper and lower ends, refrigerant inlet and outlet fittings at its upper ends connected with the recovery line and the transfer line, an oil outlet fitting at its lower end, a flow metering devise downstream of and connected with the oil outlet fitting, a normally closed drain valve downstream of and connected with the flow metering devise and an oil receiving bottle downstream of and connected with the drain valve.

13. The system and apparatus set forth in claim 1 that further includes an electric powered heater devise at the tank of the oil separator devise and operating to maintain the temperature of refrigerant and oil in the tank above the dew point of the refrigerant and below the dew point of the oil.

* * * * *